US005518070A

United States Patent [19]

Kato

[11] Patent Number: 5,518,070

[45] Date of Patent: May 21, 1996

[54] STACKED TUBE TYPE HEAT EXCHANGER

[75] Inventor: Soichi Kato, Saitama, Japan

[73] Assignee: Zexel Corporation, Tokyo, Japan

[21] Appl. No.: 547,728

[22] Filed: Oct. 26, 1995

[30] Foreign Application Priority Data

Nov. 4, 1994 [JP] Japan ..... 6-270931

[51] Int. Cl.[6] ..... F28F 21/08

[52] U.S. Cl. ..... 165/180; 165/134.1; 428/654

[58] Field of Search ..... 165/152, 180, 165/905, 134.1; 428/654; 420/537, 538

[56] References Cited

U.S. PATENT DOCUMENTS

| | | | |
|---|---|---|---|
| 4,410,036 | 10/1983 | Kanada et al. | 165/134.1 |
| 4,587,701 | 5/1986 | Koisuka et al. | 228/183 X |
| 4,716,959 | 1/1988 | Aoki | 165/152 |
| 4,749,627 | 6/1988 | Ishikawa et al. | 428/654 |
| 5,148,862 | 9/1992 | Hashiura et al. | 165/134.1 |
| 5,260,142 | 11/1993 | Kawabe et al. | 428/654 |
| 5,375,760 | 12/1994 | Doko | 228/183 |

*Primary Examiner*—Allen J. Flanigan
*Attorney, Agent, or Firm*—Kanesaka & Takeuchi

[57] ABSTRACT

In a stacked tube type heat exchanger comprising a plurality of flat tubes and fins alternately stacked in parallel to one another, the flat tube is made of aluminum alloy consisting of 0.04–0.10 wt % of Si, 0.1–0.4 wt % of Fe, 0.2–0.5 wt % of Cu, less than 0.55 wt % of Mn, the remaining portion of Al, and unavoidable impurities, the flat tube is formed by extrusion molding, and the fin is made of aluminum alloy having at least its core material containing more than 1 wt % of Zn, and both surfaces of the fin are clad in a brazing material. Another heat exchanger comprising the flat tube made of the same materials as mentioned above, and formed by extrusion molding but with both surfaces of the tube being coated with the brazing material, and the fin is made of aluminum alloy containing more than 1 wt % of Zn, without having its surfaces coated with the brazing material.

Thus, the stacked tube type heat exchanger having sufficient pitting corrosion resistibility can be obtained, even without having a Zn layer on the tube surface, and, therefore, the conventional step of thermal spraying of Zn is eliminated.

2 Claims, 3 Drawing Sheets

FIG.3

| No. | tube wt% | | | | fin | maximum depth of pitting corrosion mm | |
|---|---|---|---|---|---|---|---|
| | Si | Fe | Cu | Mn | Zn wt% | between fins | R portion |
| 1 | 0.07 | 0.15 | 0.50 | 0.01 | 1.0 | 0.098 (○) | 0.031 (○) |
| 2 | 0.07 | 0.25 | 0.29 | 0 | 0 | pitting through tube surface(×) | pitting through tube surface(×) |
| 3 | 0.07 | 0.25 | 0.29 | 0.01 | 2.0 | 0.087 (×) | 0.049 (○) |
| 4 | 0.05 | 0.27 | 0.29 | 0.46 | 0 | 0.205 (×) | 0.120 (×) |
| 5 | 0.05 | 0.27 | 0.29 | 0.46 | 1.0 | 0.083 (○) | 0.035 (○) |
| 6 | 0.05 | 0.27 | 0.45 | 0.55 | 0 | 0.180 (×) | 0.081 (○) |
| 7 | 0.06 | 0.37 | 0.38 | 0.01 | 1.0 | 0.096 (○) | 0.074 (○) |
| 8 | 0.04 | 0.34 | 0.29 | 0.38 | 0 | 0.130 (×) | 0.051 (○) |
| 9 | 0.04 | 0.34 | 0.29 | 0.38 | 1.0 | 0.095 (○) | 0.045 (○) |
| 10 | 0.25 | 0.40 | 0.05 | 0.05 | 1.0 | 0.231 (×) | 0.252 (×) |

STACKED TUBE TYPE HEAT EXCHANGER

BACKGROUND OF THE INVENTION

1. Field of the Invention

This invention relates to a stacked tube type heat exchanger comprising flat tubes formed by extrusion molding.

2. Prior Art

Generally, conventional stacked tube type heat exchanger comprises a plurality of flat tubes and fins which are alternately stacked in parallel to one another, and ends of each stacked tube are inserted respectively into tube insertion holes provided in header tanks to be assembled, and the fins are joined together with the flat tubes, and the flat tubes are connected with the header tanks, by brazing. Then, a heat exchange medium flows between an inlet joint and an outlet joint of the header tanks in a serpentine form by making a plurality of turns.

With such conventional stacked tube type heat exchanger, flat tubes are made of aluminum material and aluminum alloy material (hereinafter called "aluminum alloy"), and a plurality of panel walls are provided inside each flat tube in a direction of the width of the inner flow passage to define a plurality of paneled flow passages. Such flat tube is formed by extrusion molding.

Generally, such a flat tube is made of, for example, aluminum alloy of JIS (Japanese Industrial Standards) No. A1050, and the fin is made of another aluminum alloy. In order to improve corrosion resistance of the flat tube, a layer of Zn is provided on the tube surface by thermal spraying of Zn over the outer surface of the extrusion molded tube. Recently, brazing of an assembled heat exchanger is often made by using non-corrosive flux of fluorides in a non-oxidizing atmosphere (for example, Nokolok Method).

However, for such stacked tube type heat exchanger which is adapted to be loaded on a vehicle, demands for lowering the cost and making it light in weight are increasing. But, with the above-described conventional method the Zn layer is provided over the tube surface by thermal spraying of Zn thereon which is an extra process employed after forming the flat tube by extrusion molding. Thus, the conventional method requires such extra process, which, in turn, requires an additional cost. Consequently, an improvement has been sought. Generally, the flat tube made of aluminum alloy of JIS No. A1050 has dimensions of 0.35 mm wall thickness, 1.3 mm space between inner walls and 2.0 mm tube thickness, and pitting corrosion occurs if the Zn thermal spraying is not applied, and such pitting corrosion comes through the tube surface.

The object of the present invention is, therefore, to provide a stacked tube type heat exchanger which assures the tube's resistance to pitting corrosion, even though the flat tube surface has no Zn layer, and accordingly, the conventional extra process of thermal spraying Zn over the outer surface of the tube during manufacture is eliminated.

DISCLOSURE OF THE INVENTION

The aforementioned object can be achieved by the stacked tube type heat exchanger of the present invention. According to a first aspect of the invention, in the stacked tube type heat exchanger comprising a plurality of flat tubes and fins which are alternately stacked in parallel to one another, and ends of each of the plurality of flat tubes are connected to header tanks, the flat tube is made of aluminum alloy consisting of 0.04–0.10 wt % of Si, 0.1–0.4 wt % of Fe, 0.2–0.5 wt % of Cu, less than 0.55 wt % of Mn, the remaining component of Al, and unavoidable impurities, the flat tube is formed by an extrusion molding, and the fin is made of an aluminum alloy having at least its core material containing more than 1 wt % of Zn, and both surfaces of the fin are clad in a brazing material.

A second aspect of the invention is, in such tube-stacking type heat exchanger as described above, the flat tube is made of aluminum alloy consisting of 0.04–0.10 wt % of Si, 0.1–0.4 wt % of Fe, 0.2–0.5 wt % of Cu, less than 0.55 wt % of Mn, the remaining component of Al, and unavoidable impurities, the flat tube is formed by extrusion molding with both surfaces of the flat tube being coated with a brazing material, and the fin is made of aluminum alloy containing more than 1 wt % of Zn.

To assemble the flat tubes and fins and header tanks into such a stacked tube type heat exchanger by an integral brazing process, a plurality of flat tubes and fins are alternately stacked in parallel to one another, and ends of each of the plurality of flat tubes are inserted into tube insertion holes provided in header tanks. Then, the entire assembly is subjected to integral brazing process, thereby the fins are joined with the flat tubes, and the flat tubes are connected with the header tanks.

In this case, an addition of Si causes age precipitation of a small amount of Mg and an intermetallic compound of Mg2Si, thereby to achieve the effect of improving the strength. However, if a greater amount of Si is added, the solidus temperature is lowered, and the aluminum tube is melted by heat during brazing process. In order to have the effect with a small amount of Mg, the lower limit of Si is set to 0.04 wt %, and the upper limit is set to 0.10 wt %, because a greater amount of Si causes unsatisfactory brazing effect.

Further, additions of Cu and Fe to Al improve the strength and anticorrosion, and, particularly, improve resistance to pitting corrosion. Namely, addition of Cu improves the strength, and, at the same time, it makes the potential of the tube high, and, in combination with the corrugated fins, the tube side is made cathodic, thereby to improve resistance to pitting corrosion. In other words, the tube is made cathodic and the fin is made anodic, and consequently, the tube receives electrons so that it resists corrosion, while the fin is liable to lose electrons, and, as a result, the fin is apt to have corrosion. If Cu content is less, the anti-corrosion effect cannot be obtained. Accordingly, in view of the extrusion moldability and corrosion resistibility, an appropriate amount of Cu is in the range of 0.2–0.5 wt %. Regarding Fe content, if it is less, the effect of improving the strength cannot be achieved, while with a greater amount of Fe, the strength improvement effect is saturated, thereby a compound of Al and Fe is precipitated and self-corrosion becomes greater. Accordingly, a proper amount of Fe is in the range of 0.1–0.4 wt %.

Further, Mn is added to aid Cu in improving the strength. Since Mn makes the potential of the tube high, it also has the anticorrosion effect. However, a greater content of Mn lowers the extrusion moldability, and it is preferable not to use too much Mn. As a result of experiments, it is found that Mn of less than 0.55 wt % is appropriate.

Moreover, if the amount of Zn in the fin material is below 1 wt %, there will be not enough potential difference from the tube, thereby the sacrificial effect of the fins is weakened. Thus, it is required to use aluminum alloy containing more than 1 wt % of Zn for the fin material.

BRIEF DESCRIPTION OF THE DRAWINGS

FIG. 3 is a table of a depth of pitting corrosion occurred in various kinds of flat tubes.

DETAILED DESCRIPTION OF THE PREFERRED EMBODIMENTS

Now, a first embodiment of the present invention will be described by referring to the accompanying drawings.

Figure 1:
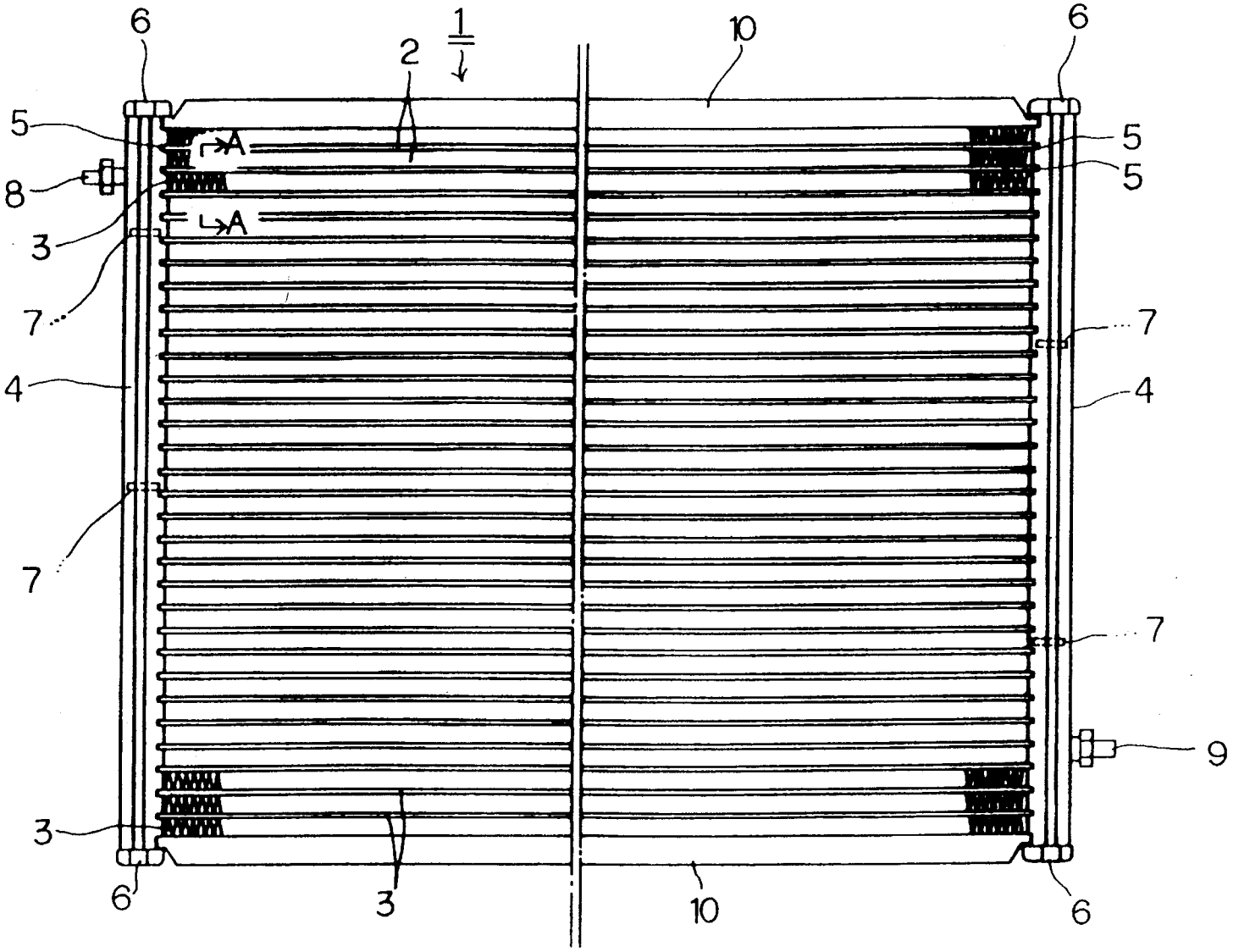
FIG. 1 is a front view of the stacked tube type heat exchanger of a first embodiment of the present invention.

As shown in FIG. 1, a stacked tube type heat exchanger 1 of this embodiment comprises a plurality of flat tubes 2 and corrugated fins 3 alternately stacked in parallel to one another, and ends of each of the plurality of flat tubes are inserted into tube insertion holes 5 provided in each header tank 4. Each of upper and lower openings of each header tank 4 is covered by a blank cap 6, and partition plates 7 are provided at predetermined places in each header tank. Further, an inlet joint 8 or an outlet joint 9 is provided at either header tank 4, and a heat exchange medium flows between the inlet and outlet joints 8 and 9 in a serpentine form by making a plurality of turns. In FIG. 1, numeral 10 designates side plates disposed at the upper and lower sides of the stacked flat tubes 2.

Figure 2:
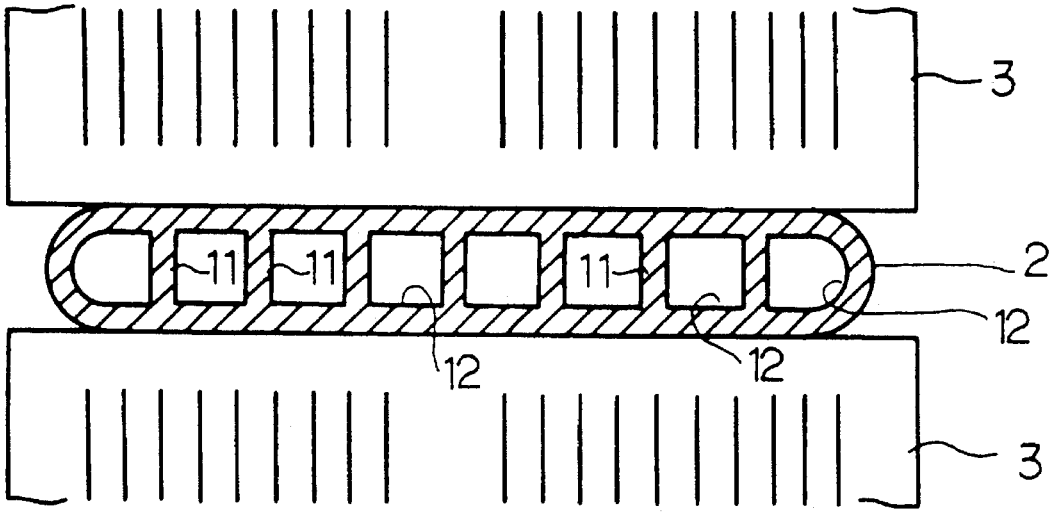
FIG. 2 is a cross-sectional view of the flat tube taken in the direction of the arrows along line A—A of FIG. 1.

Referring to FIG. 2, each flat tube 2 is provided with panel walls 11 to define a plurality of compartments in a direction of a width of the inner flow passage, thereby a plurality of paneled flow passages 12 are formed. Such flat tube 2 is formed by an extrusion molding.

While the flat tube 2 is made of a predetermined aluminum alloy, the fin 3 is made of aluminum alloy containing more than 1 wt % of Zn and formed in a brazing sheet with both surfaces coated with a brazing material.

In a second embodiment of this invention, the flat tube 2 is made of the predetermined aluminum alloy and formed by the extrusion molding with both surfaces of the flat tube being coated with the brazing material. The fin 3 is made of aluminum alloy containing more than 1 wt % of Zn. Namely, in this embodiment, the fin 3 is made of a bare material without having both surfaces coated with the brazing material, but the flat tube 2 has both surfaces coated with the brazing material.

For assembly of the heat exchanger 1, the plurality of flat tubes 2 and the corrugated fins 3 are alternately stacked in parallel to one another, and ends of each of the plurality of flat tubes 2 are inserted into the tube insertion holes 5 provided in each header tank 4. Then, this assembled body is subjected to an integral brazing process at a temperature of about 600° C., thereby the fins 3 are joined together with the flat tubes 2, and the flat tubes 2 are connected with each header tank 4.

In this case, a flux material of fluorides is applied to the assembled heat exchanger 1, which allows melting of Al—Si brazing material at the temperature of about 600° C. in nitrogen atmosphere, so that the fins 3 and the surfaces of flat tubes 2 are brazed together.

Specifically, the flat tube 2 has dimensions of 0.35 mm of wall thickness, 1.3 mm of space between inner walls, and tube thickness of 2.0 mm. After assembly of the aluminum alloy (flat tubes) and fin materials into the tube-stacking type heat exchanger and subjecting the assembly to brazing process, the formed heat exchanger is tested by the CASS test (pitting corrosion test) for 360 hours, to measure the maximum depth of pitting corrosion of the outer surface of the flat tube between the fins, and the maximum depth of pitting corrosion of the tube at the end (R portion). A result of the test is shown in Table of FIG. 3. In this Table, Item No. 10 is a tube made of aluminum alloy of JIS No. A1050 without having thermal spraying of Zn over the tube surface.

Further, in the Table of FIG. 3, Mn is added to help Cu in improving the strength. However, from the standpoint of extrusion moldability, Mn of less than 0.55 wt % is appropriate.

As described above, the present invention uses such materials that the potential of the tube is made high, and the potential of the fin is made low. Then, the tubes and fins of such materials are brazed together, so as to secure sufficient sacrificial effect of the fins. Consequently, sufficient corrosion resistance is assured, and specifically, the pitting corrosion resistance is improved.

What is claimed is:

1. In a stacked tube type heat exchanger comprising a plurality of flat tubes and fins alternately stacked in parallel to one another, and ends of each of said plurality of flat tubes are connected to header tanks, the heat exchanger is characterized in that the flat tube is made of aluminum alloy consisting of 0.04–0.10 wt % of Si, 0.1–0.4 wt % of Fe, 0.2–0.5 wt % of Cu, less than 0.55 wt % of Mn, the remaining portion of Al, and unavoidable impurities, said flat tube is formed by extrusion molding, and the fin is made of aluminum alloy having at least its core material containing more than 1 wt % of Zn, and both surfaces of said fin are clad in a brazing material.

2. In a stacked tube heat exchanger comprising a plurality of flat tubes and fins alternately stacked in parallel to one another, and ends of each of said plurality of flat tubes are connected to each header tank, the heat exchanger is characterized in that the flat tube is made of aluminum alloy consisting of 0.04–0.10 wt % of Si, 0.1–0.4 wt % of Fe, 0.2–0.5 wt % of Cu, less than 0.55 wt % of Mn, the remaining portion of Al, and unavoidable impurities, said flat tube is formed by extrusion molding with both surfaces of the tube being coated with a brazing material, and the fin is made of aluminum alloy containing more than 1 wt % of Zn.

* * * * *